US012145237B2

(12) United States Patent
Lim

(10) Patent No.: US 12,145,237 B2
(45) Date of Patent: Nov. 19, 2024

(54) SPEED-CONTROLLED AUTO BRUSHING OF RULES

(71) Applicant: Seoul Laser Dieboard System Co., Ltd., Foothill Ranch, CA (US)

(72) Inventor: Kyong Chan Lim, Irvine, CA (US)

(73) Assignees: SDNS, INC., Lake Forest, CA (US); SEOUL LASER DIEBOARD SYSTEM CO., LTD., Gyeonggi-Do (KR)

( * ) Notice: Subject to any disclaimer, the term of this patent is extended or adjusted under 35 U.S.C. 154(b) by 1311 days.

(21) Appl. No.: 16/719,641

(22) Filed: Dec. 18, 2019

(65) Prior Publication Data

US 2020/0198082 A1 Jun. 25, 2020

Related U.S. Application Data

(60) Provisional application No. 62/784,139, filed on Dec. 21, 2018.

(51) Int. Cl.

| | |
|---|---|
| ***B24B 7/12*** | (2006.01) |
| ***B24B 27/033*** | (2006.01) |
| ***B24B 29/00*** | (2006.01) |
| ***B24B 29/06*** | (2006.01) |
| ***B24B 49/00*** | (2012.01) |

(52) U.S. Cl.

CPC ..... *B24B 7/12* (2013.01); *B24B 27/033* (2013.01); *B24B 29/005* (2013.01); *B24B 29/06* (2013.01); *B24B 49/006* (2013.01)

(58) Field of Classification Search

CPC .. B24B 7/12; B24B 7/13; B24B 9/002; B24B 27/033; B24B 29/005; B24B 29/06; B24B 29/08; B24B 49/006

USPC ..... 451/5, 10, 11, 54, 59, 65, 66, 67, 167, 451/184, 300

See application file for complete search history.

(56) References Cited

U.S. PATENT DOCUMENTS

| | | | | |
|---|---|---|---|---|
| 2,191,814 A * | 2/1940 | Brown | B24B 7/13 | 451/28 |
| 2,244,536 A * | 6/1941 | Herchenrider | B24B 21/004 | 451/313 |
| 2,567,163 A * | 9/1951 | Wallace | B24B 7/13 | 451/73 |
| 3,277,609 A * | 10/1966 | Horie | B24B 7/12 | 451/28 |
| 3,991,462 A * | 11/1976 | Engel | H01F 41/063 | 29/605 |
| 5,562,525 A * | 10/1996 | Mori | B24B 49/16 | 451/425 |

(Continued)

FOREIGN PATENT DOCUMENTS

CN 105234761 A * 1/2016

*Primary Examiner* — Eileen P Morgan
(74) *Attorney, Agent, or Firm* — Procopio, Cory, Hargreaves & Savitch LLP

(57) ABSTRACT

Method and system, including: a strip of metallic material used by a bender to produce the 3-D signage; a sanding unit coupled to the bender and configured to sand away any dirt, oil, or other undesirable material attaching to the strip of metallic material; and a controller configured to make a measurement of how fast the strip of metallic material is feeding into the bender, and to control an operating speed of the sanding unit based on the measurement.

6 Claims, 5 Drawing Sheets

(56) References Cited

U.S. PATENT DOCUMENTS

| | | | | |
|---|---|---|---|---|
| 6,497,793 | B1 * | 12/2002 | Ahonen | D21H 25/005 162/204 |
| 2015/0318651 | A1 * | 11/2015 | Ueda | H01C 1/12 439/26 |
| 2019/0283085 | A1 * | 9/2019 | Lim | B08B 1/04 |

* cited by examiner

SPEED-CONTROLLED AUTO BRUSHING OF RULES

CROSS-REFERENCE TO RELATED APPLICATIONS

This application claims the benefit of priority under 35 U.S.C. § 119(e) of U.S. Provisional Patent Application No. 62/784,139, filed Dec. 21, 2018, entitled "Speed-Controlled Auto Brushing of Rules." The disclosure of the above-referenced application is incorporated herein by reference.

BACKGROUND

Technological Field

The present disclosure relates to brushing of rules for channel letters, and in particular, to controlling the speed of the brushing process.

Background

Three-dimensional signage displays (sometimes referred to as "channel letters") are installed to inform the consumers of the name and nature of the businesses. Thus, the signage displays enable the consumers to easily recognize and understand the nature of the businesses. The signage displays include illumination units to easily identify the businesses during the day as well as night time. The three-dimensional signage display includes a side frame with a tubular opening (sometimes referred to as "letter box"), an upper panel or cover (which rests on top of the side frame), and a base module which includes illumination devices such as light emitting diodes (LEDs).

The side frame is usually formed with a strip of metallic material such as aluminum or steel. Thus, a bender bends the strip of metallic material (sometimes referred to a rule or profile) into the three-dimensional shape such that the light from the illumination devices is transmitted through the upper panel to light the three-dimensional signage. The strip of metallic material is often fed into the bender from a large and heavy roll.

SUMMARY

In general, this disclosure describes system and methods related to brushing of rules for channel letters. The brushing process is then controlled by controlling the speed of the sanding unit and the brushing unit.

In one implementation, a brushing system for a 3-D signage is disclosed. The system includes: a strip of metallic material used by a bender to produce the 3-D signage; a sanding unit coupled to the bender and configured to sand away any dirt, oil, or other undesirable material attaching to the strip of metallic material; and a controller configured to make a measurement of how fast the strip of metallic material is feeding into the bender, and to control an operating speed of the sanding unit based on the measurement.

In one implementation, the system further includes: a roll of metallic material; and a pressing unit configured to press the roll of metallic material to produce the strip of metallic material. In one implementation, the operating speed of the sanding unit comprises a spin speed of sanding material of the sanding unit. In one implementation, the system further includes a brushing unit including at least one of spinning brush, laterally-moving brush, and vertically-moving brush, wherein the brushing unit is coupled to the bender and is configured to remove any extracted material due to sanding of the strip of metallic material by the sanding unit. In one implementation, the controller is also configured to control an operating speed of the brushing unit. In one implementation, the operating speed of the brushing unit comprises at least one of spin, lateral, and vertical movement speed of the at least one of spinning brush, laterally-moving brush, and vertically-moving brush.

In another implementation, a method for a 3-D signage is disclosed. The method includes: making a measurement of how fast a strip of metallic material is feeding into a bender; and controlling an operating speed of a sanding unit based on the measurement, wherein the sanding unit is coupled to the bender, and sands away any dirt, oil, or other undesirable material attaching to the strip of metallic material.

In one implementation, the method further includes pressing a roll of metallic material to produce the strip of metallic material. In one implementation, the operating speed of the sanding unit comprises a spin speed of sanding material of the sanding unit.

Other features and advantages should be apparent from the present description which illustrates, by way of example, aspects of the disclosure.

BRIEF DESCRIPTION OF THE DRAWINGS

The details of the present disclosure, both as to its structure and operation, may be gleaned in part by study of the accompanying drawings.

DETAILED DESCRIPTION

Figure 1:
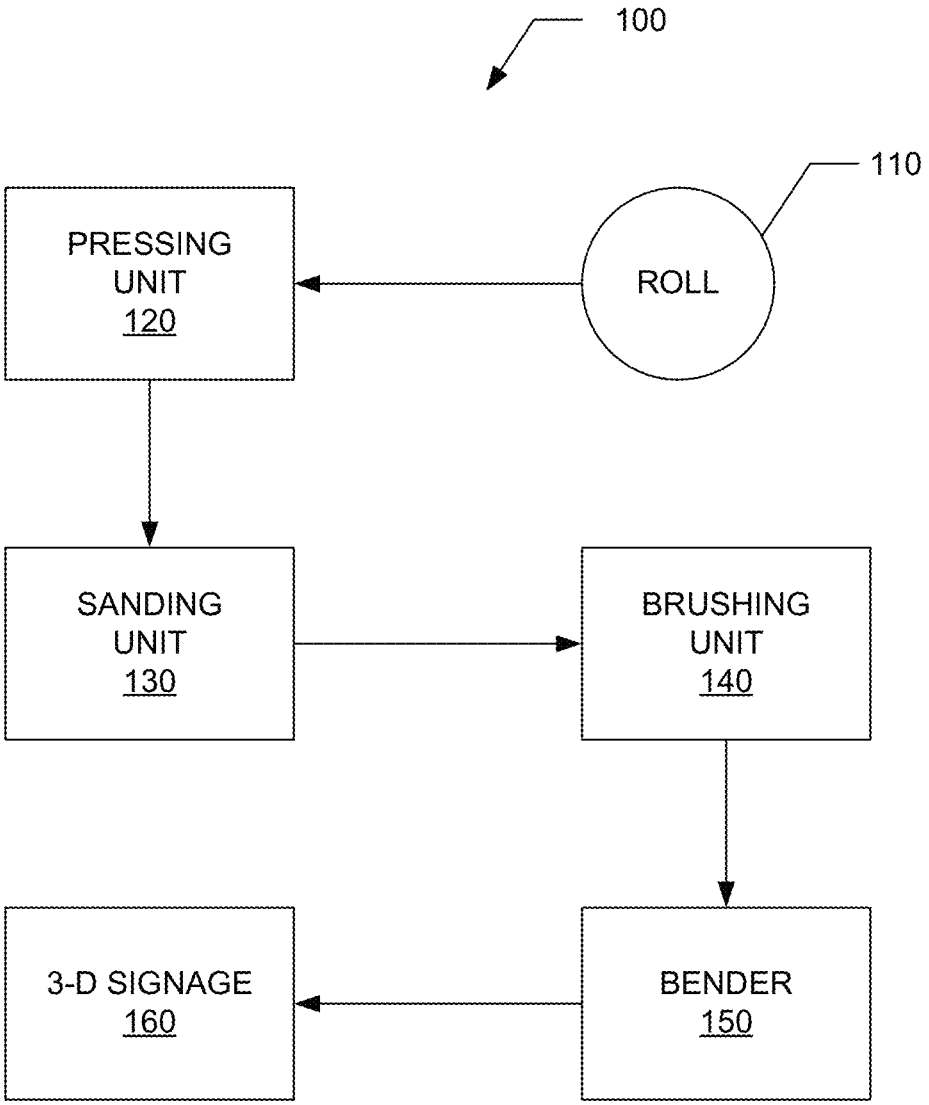
FIG. 1 is a block diagram of a system used to produce a 3-D signage (i.e., a channel letter) from a roll of metallic material in accordance with one implementation of the present disclosure.

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. In some instances, well-known structures and components are shown in simplified form for brevity of description. As used herein, like reference numerals refer to like features throughout the written description.

Prior to bending the rule to form the letter box, the rule needs to be processed. For example, the rule should be processed to remove any dust or stain as well as oil on the surface. In some cases, the roll of metallic material (often for thick material) is coated with oil to provide a smooth surface for the strip of rule as it is unspooled from the roll.

FIG. 1 is a block diagram of a system 100 used to produce a 3-D signage 160 (i.e., a channel letter) from a roll 110 of metallic material in accordance with one implementation of the present disclosure. In FIG. 1, the roll 110 of metallic material is fed into several different processing units 120, 130, 140 to process the rule before it is fed into the bender 150.

For example, a pressing unit 120 is configured to press the roll 110 of metallic material into a straight strip of rule. A sanding unit 130 is configured to sand away any dirt, oil, and/or other undesirable material on the strip of rule to provide a smooth strip of rule for the bender 150. A brushing unit 140 is configured to remove any extracted material due to the sanding of the strip of rule. The bender 150 then bends the processed strip of rule into a desired shape to produce the 3-D signage 160.

In operation, the bender 150 receives the strip of material feeding into it and constantly adjusts the feeding speed to bend the material into a desired shape. In the process, the strip of material may even go backwards or stay almost stationary to measure and bend the strip of material. However, when the units 120, 130, 140 are coupled to the bender 150 (to process the strip of material prior to bending), the movement of the bender 150 stopping, slowing, or moving backwards may cause several different problems for the strip of material. For example, when the bender 150 is stopped to measure a particular distance between points on the strip of material, the sanding unit 130 and/or the brushing unit 140 may continue to sand and brush the same spot over and over again, which may cause streaks and/or spots on the strip of material. Similar streaks and/or spots may show when the bender 150 causes the strip of material to go backwards during the bending operation.

Figure 2A:
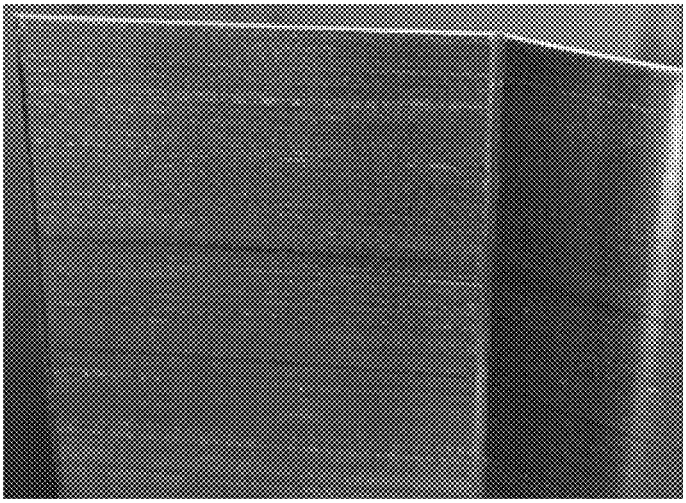
FIGS. 2A through 2C show some of the different problems caused by the "uneven-speed" movement of the bender.
Figure 2B:
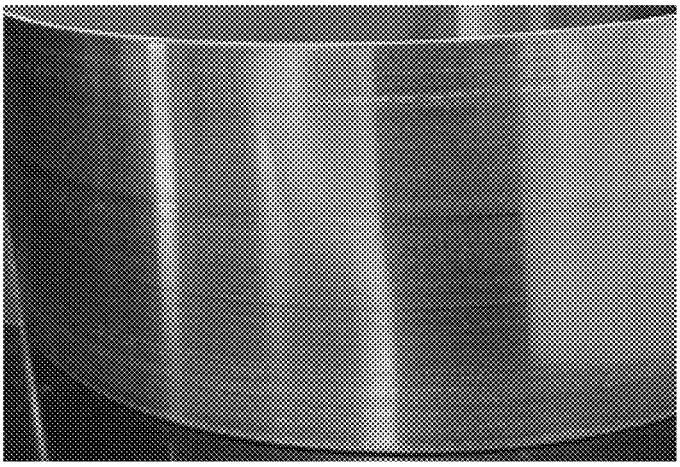
Figure 2C:
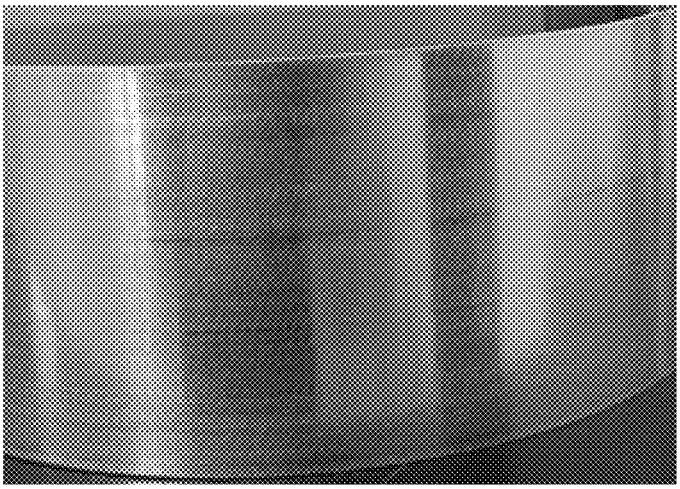

FIGS. 2A through 2C show some of the different problems caused by the "uneven-speed" movement of the bender 150. For example, since the sanding unit 130 continues to sand away on the strip of material without regard to the movement of the bender 150, the constant sanding by the sanding unit 130 may cause streaking or spots of shiny area (where the area was being sanded, for example, during the stoppage of the bender 150). Although the streaks or spots on the inside surface of the channel letter may be acceptable, but the streaks or spots on the outer surface of the channel letter may be unacceptable for the esthetic purposes. Therefore, it may be desirable to control the operating speed (e.g., spin speed or lateral movement speed of a brush or sanding material) of the units 120, 130, 140 such that the streaks and/or spots on the strip are minimized. For example, the feedback signal from the bender 150 may stop the units 120, 130, 140 from rotating when the bender 150 stops and/or moves backward.

Figure 3:
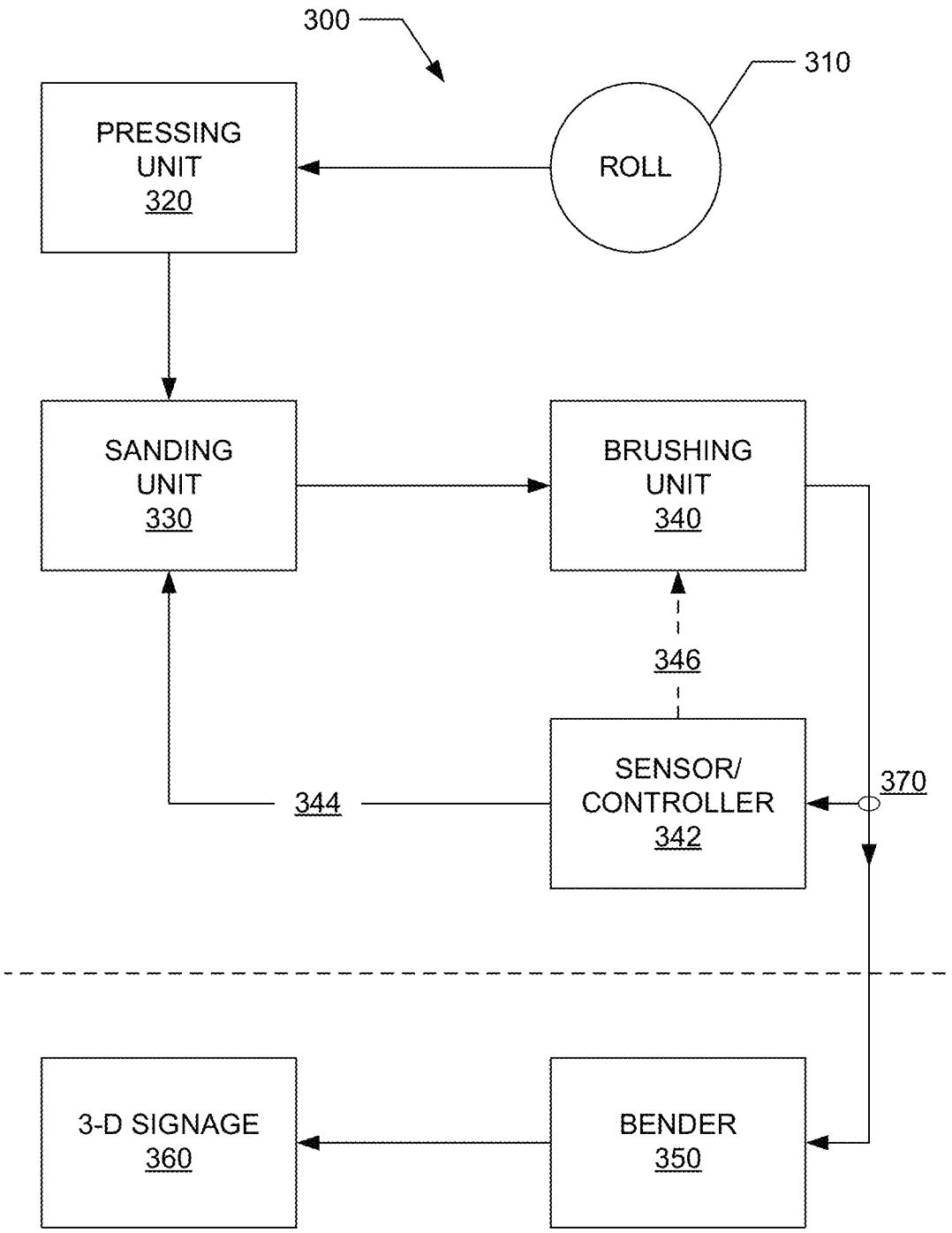
FIG. 3 is a block diagram of a self-controlled auto brushing system used to produce the 3-D signage from a roll of metallic material in accordance with another implementation of the present disclosure.

FIG. 3 is a block diagram of a self-controlled auto brushing system 300 used to produce the 3-D signage 160 from a roll 110 of metallic material in accordance with another implementation of the present disclosure. In other implementations, material other than metallic material may be used. In the illustrated implementation of FIG. 3, the roll 310 of metallic material is fed into at least one processing unit 320, 330, 340, as before, to process the rule before it is fed into the bender 350 to produce the 3-D signage 360.

For example, a pressing unit 320 is configured to press the roll 310 of metallic material into a straight strip of rule. A sanding unit 330 is configured to sand away any dirt, oil, and/or other undesirable material on the strip of rule to provide a smooth strip of rule for the bender 350. A brushing unit 340 is configured to remove any extracted material due to the sanding of the strip of rule. The bender 350 then bends the processed strip of rule into a desired shape to produce the 3-D signage 360.

In operation when the units 320, 330, 340 are coupled to the bender 350 (to process the strip of material prior to bending), the bender 350 receives the strip of material feeding into it and constantly adjusts the feeding speed to bend the material into a desired shape. In the process, the strip of material may even go backwards or stay almost stationary to measure and bend the strip of material.

However, in the illustrated implementation of FIG. 3, the system 300 further includes a sensor/controller 342 which senses/measures 370 how fast the strip of material is feeding (i.e., the speed at which the strip of material is moving in and out) into the bender 350. The sensor/controller 342 is also configured to control the operating speed of the units 320, 330, 340 based on the sensed measurement 370. In one implementation, the sensed measurement 370 is then fed back 344 to the sanding unit 330 to control the operating speed of the sanding unit 330 in accordance with the sensed measurement. In another implementation, the sensed measurement 370 is also fed back 346 to the brushing unit 340 to control the operating speed of the brushing unit 330 in accordance with the sensed measurement as well. Accordingly, the 3-D signage 360 produced by the bender 350 may provide an evenly smooth surface with substantially less streaks and spots than a system without the sensor/controller 342. In yet another implementation, the sensed measurement 370 is also fed back to the pressing unit 320 to control the spinning speed of the pressing unit 320 in accordance with the sensed measurement as well.

In one implementation, the sanding unit 330 includes at least one of spinning sander, laterally-moving sander, and vertically-moving sander. In one implementation, the operating speed of the sanding unit 330 includes a spin speed of the sanding material in the sanding unit. In one implementation, the brushing unit 340 includes at least one of spinning brush, laterally-moving brush, and vertically-moving brush. In one implementation, the operating speed of the brushing unit includes at least one of spin, lateral, and vertical movement speed of the at least one of spinning brush, laterally-moving brush, and vertically-moving brush.

Figure 4:
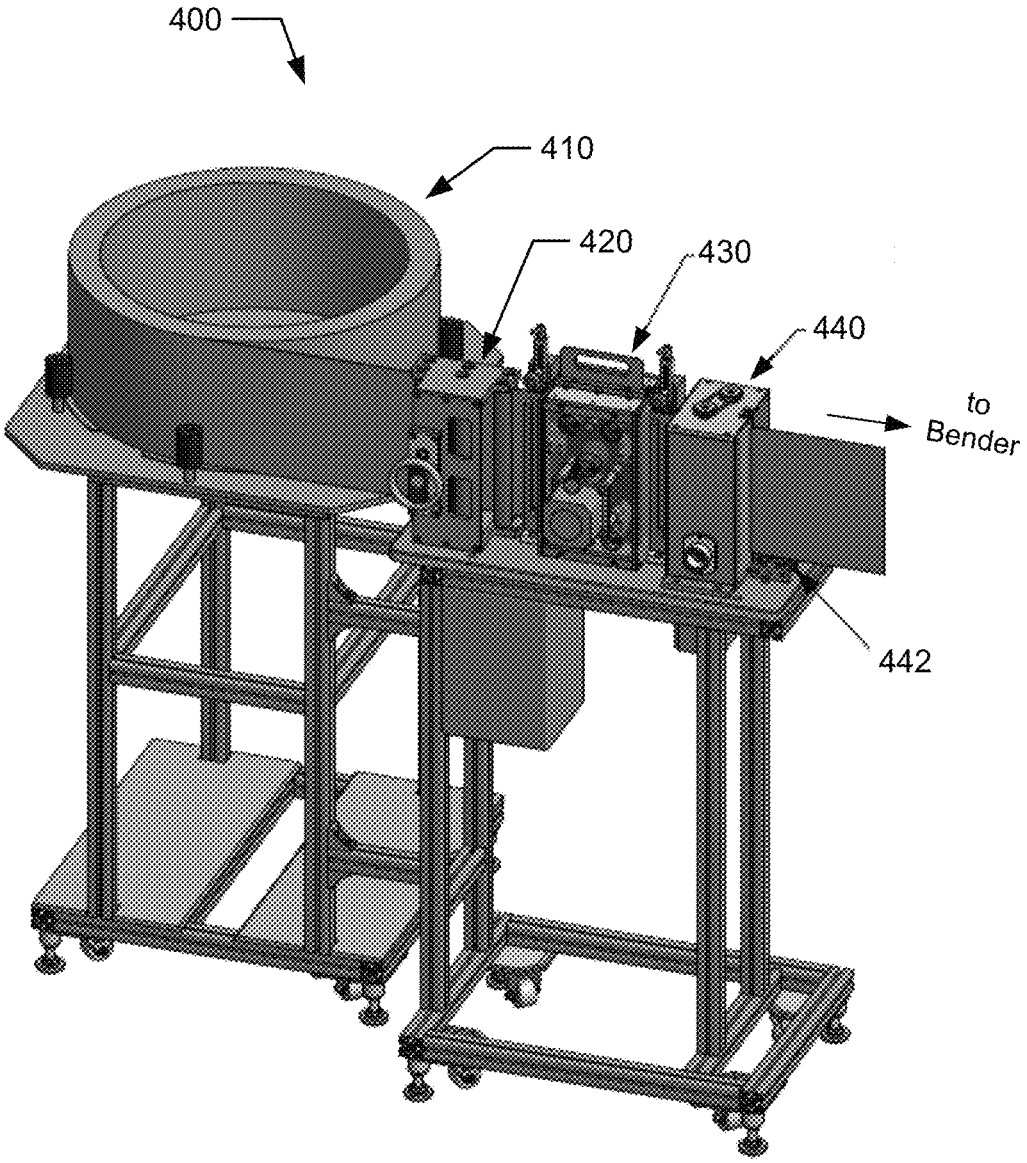
FIG. 4 is a schematic diagram of a self-controlled auto brushing system used to produce the 3-D signage from a roll of metallic material in accordance with another implementation of the present disclosure.

FIG. 4 is a schematic diagram of a self-controlled auto brushing system 400 used to produce the 3-D signage from a roll 410 of metallic material in accordance with another implementation of the present disclosure. In the illustrated implementation of FIG. 4, the roll 410 of metallic material is fed into several different processing units 420, 430, 440 to process the rule before it is fed into the bender to produce the 3-D signage.

As before, the pressing unit 420 is configured to press the roll 410 of metallic material into a straight strip of rule. The sanding unit 430 is configured to sand away any dirt, oil, and/or other undesirable material on the strip of rule to provide an evenly smooth (i.e., free of streaks and spots) strip of rule for the bender. The brushing unit 440 is configured to remove any extracted material due to the sanding of the strip of rule. The extracted material is then sent to the bender to bend the processed strip of rule into a desired shape to produce the 3-D signage.

The system 400 also includes a sensor/controller 442 which senses/measures how fast the strip of material is feeding (i.e., the speed at which the strip of material is moving in and out) into the bender. In one implementation, the sensed measurement is then fed back to the sanding unit 430 to control the spin speed of the sanding unit 430 in accordance with the sensed measurement. In another implementation, the sensed measurement is also fed back to the brushing unit 440 to control the spin speed of the brushing unit 440 in accordance with the sensed measurement as well. Accordingly, the 3-D signage produced by the bender may provide an evenly smooth surface.

Figure 5:
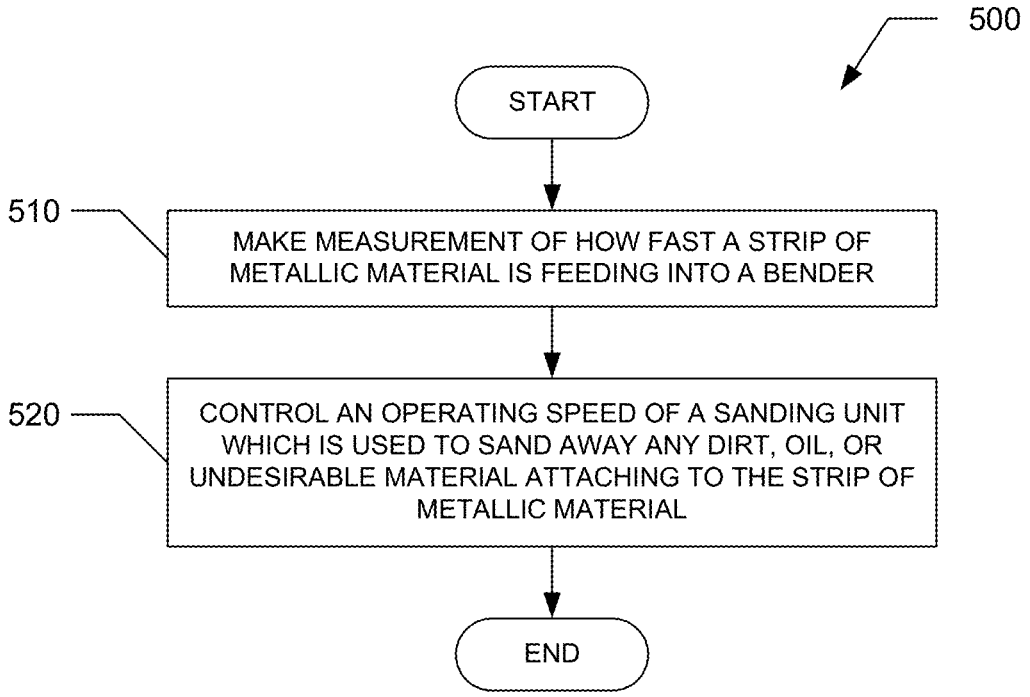
FIG. 5 is a flow diagram of a method for a 3-D signage in accordance with one implementation of the present disclosure.

FIG. 5 is a flow diagram of a method 500 for a 3-D signage in accordance with one implementation of the present disclosure. In the illustrated implementation of FIG. 5, a measurement is made, at step 510, of how fast a strip of metallic material is feeding into a bender. An operating speed of a sanding unit is then controlled, at step 520, based on the measurement. The sanding unit is configured to sand away any dirt, oil, or other undesirable material attaching to the strip of metallic material.

The above descriptions of the disclosed embodiments are provided to enable any person skilled in the art to make or use the disclosure. Various modifications to these embodiments will be readily apparent to those skilled in the art, and the generic principles described herein can be applied to other embodiments without departing from the spirit or scope of the disclosure. For example, although the examples shown in the illustrated figures include only the strips of metallic material, other shapes and materials such as rectangular pieces and non-metallic material may be used. Thus, it will be understood that the description and drawings presented herein represent embodiments of the disclosure and are therefore representative of the subject matter which is broadly contemplated by the present disclosure. It will be further understood that the scope of the present disclosure fully encompasses other embodiments that may become obvious to those skilled in the art and that the scope of the present disclosure is accordingly limited by nothing other than the appended claims.

Accordingly, the foregoing embodiments are merely presented as examples and are not to be construed as limiting the present disclosure. The present teachings can be readily applied to other types of apparatus and/or devices. The description of the present disclosure is intended to be illustrative, and not to limit the scope of the claims. Many alternatives, modifications, and variations will be apparent to those skilled in the art.

What is claimed is:

1. A sanding and brushing system for a strip of metallic material used by a bender to produce a 3-D signage, the sanding and brushing system coupled to a bender, the sanding and brushing system comprising:

a sanding unit including sanding material to sand away any dirt, oil, or other undesirable material attached to the strip of metallic material used by the bender to produce the 3-D signage;

a controller for 1) measuring the feed speed of the strip of metallic material when the strip of metallic material is fed into the bender, and 2) to control a spin speed of the sanding material of the sanding unit based on the feed speed measurement; and a brushing unit configured to remove any extracted material due to sanding of the strip of metallic material by the sanding unit.

2. The system of claim 1, further comprising:

a pressing unit configured to receive and press a roll of metallic material to produce the strip of metallic material that is flat enough for the sanding unit.

3. The system of claim 1, wherein the spin speed of the sanding material comprises a spin speed of the brushing unit.

4. The system of claim 1, wherein the brushing unit comprises at least one of spinning brush, laterally-moving brush, and vertically-moving brush.

5. The system of claim 4, wherein the controller is also configured to control an operating speed of the brushing unit.

6. The system of claim 5, wherein the operating speed of the brushing unit comprises at least one of spin, lateral, and vertical movement speed of the at least one of spinning brush, laterally-moving brush, and vertically-moving brush.

* * * * *